United States Patent [19]

Burnett

[11] Patent Number: 4,493,877

[45] Date of Patent: Jan. 15, 1985

[54] SUPPORT MEMBER

[76] Inventor: John S. Burnett, 51 Coldharbour La., Bushey, Herts., England

[21] Appl. No.: 231,829

[22] Filed: Feb. 5, 1981

[30] Foreign Application Priority Data

Feb. 7, 1980 [GB] United Kingdom ..... 8004084
Mar. 14, 1980 [GB] United Kingdom ..... 8008654

[51] Int. Cl.[3] ..... A47C 13/00
[52] U.S. Cl. ..... 428/542.8; 264/123; 297/1; 297/130; 297/DIG. 3
[58] Field of Search ..... 428/542.8; 297/1, 130, 297/DIG. 3; 264/123; 5/449; 128/595

[56] References Cited

U.S. PATENT DOCUMENTS 3,594,335 7/1971 Schultz ..... 264/123

FOREIGN PATENT DOCUMENTS 926722 5/1963 United Kingdom .
1095311 12/1967 United Kingdom .

*Primary Examiner*—John E. Kittle
*Attorney, Agent, or Firm*—Pollock, Vande Sande & Priddy

[57] ABSTRACT

A support device, suitable for the physically handicapped, and also for packaging delicate objects, consists of an airtight flexible bag filled with a granular material coated with an adhesive. A non-return valve is provided to allow a partial vacuum to be established within the bag. In use, the bag when non-evacuated of air, is pushed against a body to be supported so that the granular material flows and assumes a shape closely conforming to the body. Air is then evacuated from the bag and as a result the granular material is compressed into a rigid mass in the conformed shape. The mass is then made permanently rigid by activating the adhesive coating, for example with microwave radiation.

7 Claims, 5 Drawing Figures

FIG.1.
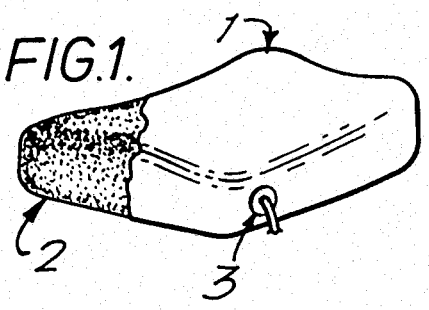
FIG.2.
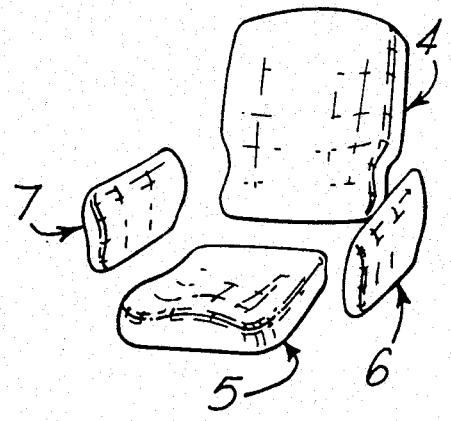
FIG.3.
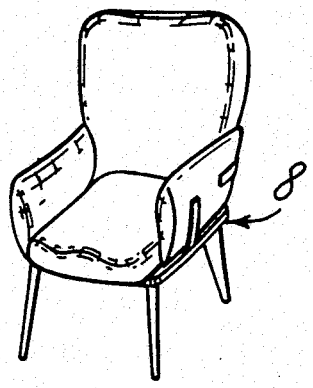
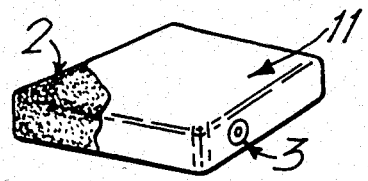
FIG.4.
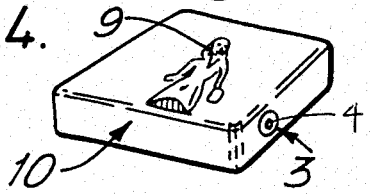
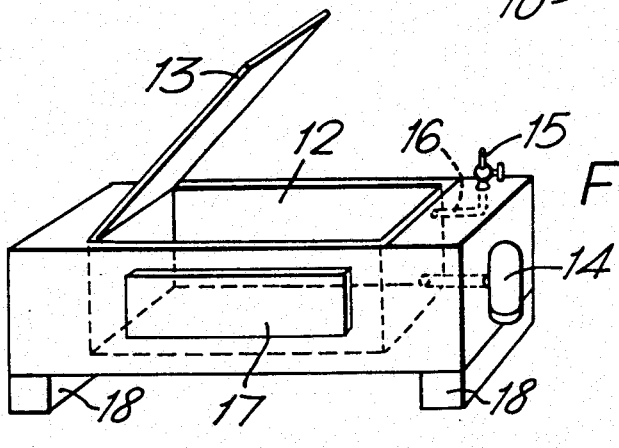
FIG.5.

SUPPORT MEMBER

FIELD OF THE INVENTION

This invention relates to a device for conforming intimately to the shape of and for supporting a body, and to a method of forming such a device. The invention has particular but not exclusive application to forming a support device such as a chair for a physically handicapped person, and also to providing packaging for articles to be transported, particularly fragile articles such as items of china and glass.

BACKGROUND OF THE INVENTION

It is known from British Pat. No. 926,722 to provide a medical support consisting of a flexible bag made of synthetic plastic material, filled with a granular material. The bag is fitted with a valve, so that the bag can be maintained in a condition evacuated of air. In use, the bag in its non-evacuated state is pushed against a patient to be supported and the granular material flows to allow the bag to take up a shape closely conforming to the shape of the patient. The bag is then evacuated of air through the valve, causing the granular material to become compressed by virtue of the resulting pressure differential across the flexible wall of the bag. As a result, the previously flexible support device becomes rigid, with the granular material becoming locked into a rigid support mass in a shape closely conforming to the shape of the body being supported.

British Pat. No. 1,095,311 discloses a similar arrangement, used to package delicate objects.

These prior arrangements provide a support which intimately conforms to the shape of an object being supported. However, in order for the rigid support to be maintained, the bag must be maintained in its evacuated condition. Maintenance of the evacuated condition over long periods of time, e.g., weeks or months, as would be required say for a medical splint, is difficult to achieve, and for the packaging application, if the bag becomes punctured in transit, the intimate support for the packaged article is lost.

OBJECT AND SUMMARY OF THE INVENTION

It is an object of the present invention to provide a device capable of conforming intimately to the shape of a body to be supported, but which does not have to be maintained in an evacuated condition for long periods of time.

This object is realized in accordance with the present invention by providing a support device consisting of a flexible bag, typically made of plastic material, filled with a granular material, and means, such as non-return valve, for permitting the bag to be maintained in a condition evacuated or air. The granular material is so arranged that, when the bag is non-evacuated of air, the granular material will flow in the bag, but also such that it can be subsequently treated to cause the granules thereof physically to adhere to one another to form a rigid mass. In one example, the granules are coated with an adhesive, which can be activated by exposing the bag to microwave radiation.

In use, the device, when non-evacuated of air, is pushed against a body to be supported. Consequently, the granular material flows around the body and takes up a shape which is a facsimile of the body to be supported. The bag is then evacuated of air and the resulting pressure differential across the bag compresses the granular material into a rigid mass in the facsimile shape. The resulting rigid bag is then treated to activate the granular material and cause the granules thereof to adhere to one another, for example by exposing the bag to microwave radiation. As a result, a permanently rigid mass is formed closely conforming to the shape of the body. If the partial vacuum within the bag is lost, as a result of a puncture or leakage, the rigidity of the support provided by the device remains due to the adherence of the granular material into a rigid mass.

The invention has application to providing supports for physically handicapped and deformed people, medical supports, and to packaging delicate articles.

In order that the invention may be more fully understood, two embodiments thereof will now be described by way of illustrative example with reference to the accompanying drawings, the first embodiment being a chair for a physically handicapped person, the chair being lined with support devices according to the invention, the second embodiment being packaging members for packaging a delicate object.

BRIEF DESCRIPTION OF THE DRAWINGS

FIG. 1 is a perspective, part sectional view of a support device according to the invention, for use in a chair for a physically handicapped person;

FIG. 2 is a perspective view of a plurality of such support members, comprising components of a chair, formed to the shape of a physically handicapped person;

FIG. 3 is a perspective view of the devices of FIG. 2 attached to a frame, to provide the chair;

FIG. 4 illustrates, in partial section, support devices of the invention used in packaging a delicate object; and FIG. 5 is an illustration of a machine for processing the support devices shown in FIG. 4.

DESCRIPTION OF PREFERRED EMBODIMENTS

Referring firstly to FIG. 1, there is shown a support device in accordance with the invention, comprising a flexible airtight generally rectangular bag 1, typically made of plastic material such as PVC, filled with a granular material 2, the granules of which are coated with an adhesive that is initially non-active but which can be activated selectively to adhere the granules to one another. The granular material may comprise wood flour coated with powdered acrylic or PVA adhesive. An air outlet tube 3 is connected to the bag 1, and a non-return valve 4 is provided in the tube 3 to allow a partial vacuum to be maintained within the bag 1.

Referring now to FIGS. 2 and 3, a plurality of such support devices of appropriate sizes, referenced 4 through 7 are installed as the back, sides and seat of a chair for a physically deformed or handicapped person, the devices 4 to 7 being mounted in a chair frame 8.

In use, the devices 4 to 7 are initially in a non-evacuated state, i.e., atmospheric pressure exists within the bags 1. A handicapped or deformed person then sits in the chair. As a result, the granular material 2 within the bags 1 flows such that the bags assume a shape closely conforming to the shape of the person sitting in the chair. If necessary, manual assistance may be provided to urge the bags into intimate contact with the sitter. Air is then sucked out of the bags 1, typically by manual suction, utilizing each tube 3 as a mouthpiece tube. Alternatively a suction pump can be used. Consequentially a pressure differential is established across the walls of the bags, and since the bags 1 are flexible, a compressive force is applied to the granular contents of the bags and locks the granular material 2 into a rigid mass in the shape which conforms to that of the person sitting in the chair. The valves 4 maintain the bags 1 in an evacuated and hence rigid state.

The bags 1 are then treated so as to activate the adhesive coating of the granular material 2 and, as a result, granules adhere to one another to form a rigid mass in the shape conforming closely to the shape of the sitter. After the adhesive has set, it is no longer necessary to maintain the partial vacuum within each bag 1 in order to keep the support device rigid.

Typically, the adhesive coating of the granular material 2 is activated by taking each device 4 to 7 from the chair frame 8, with the partial vacuum maintained, and placing the device in a microwave oven. The microwave energy from the oven heats and melts the adhesive coating, causing the granular material 2 to become stuck together.

The devices 4 to 7 are then returned to the chair frame so as to provide a permanent, rigid support for the physically handicapped person, the support being tailored individually to the shape of the person. It will be appreciated that conventional chairs do not provide satisfactory support for the physically handicapped and promote discomfort if sat upon for long periods of time. Thus the chair according to the invention provides a substantial improvement in comfort for the physically handicapped, by providing an intimate sedentary body support.

While the invention has been described in relation to a chair, it can be utilized to provide other support devices for the physically handicapped, for example limb supports, and also has medical applications to provide splints and like supports for broken and sprained parts of the body.

The invention can also be used to support inanimate objects, and is particularly suited to providing packaging for delicate items, as will now be described with reference to FIGS. 4 and 5.

In FIG. 5, a delicate china statuette 9 to be packaged is placed between two support devices 10, 11 in accordance with the invention. Each support device 10, 11 is similar in construction to the device shown in FIG. 1, and comprises a rectangular airtight bag 1 made of flexible plastic material and filled with an adhesive coated granular material 2, typically as described with reference to FIG. 1. The bag 1 has an air outlet 3 which includes a non-return valve 4.

The resulting sandwich of the devices 10, 11 and the article 9 to be packaged, is placed into a machine for processing the devices, this machine shown in FIG. 5, comprises means defining a chamber 12 which receives the aforesaid sandwich 9, 10, 11, the chamber 12 being provided with a hinged airtight lid 13. A vacuum pump 14 has an air inlet connected to the chamber 12 so as to evacuate it of air. A bleed valve 15 connected in a conduit 16 is provided to release a partial vacuum established in the chamber 12 by the pump 14. A microwave heating element 17 is provided to irradiate the contents of the chamber 12 with microwave radiation. Low frequency vibrators 18 are provided to shake the machine.

The machine processes the support devices 10, 11, to form them into generally rigid members closely conforming to the shape of the article 9.

In use, the aforesaid sandwich 9, 10, 11 is fitted into the chamber 12 and the lid 13 is shut. The vibrators 18 are switched on to cause the granular material 2 in the bags 1 to flow so as to conform closely to the shape of the article 9 to be packaged. The vacuum pump 14 is then switched on so as to extract air from the chamber 12. As a consequence, air is extracted from the bags 1 through the non-return valves 4. The bleed valve 15 is then opened and the vacuum pump 14 switched off so as to restore atmospheric pressure to the chamber 12. The action of the non-return valves 4 however maintains a reduced pressure within the bags 1 so as to rigidify the granular material 2. The uppermost support device 11 may then be lifted from the machine and the article 9 removed. The support device 11 is then returned to the chamber 12, and the microwave element 17 is switched on to activate the adhesive coating of the granular material 2, and thereby adhere the granular material into a rigid mass closely conforming to the shape of the article 9.

The article 9 can then be packaged between the rigidified devices 10, 11 for transport. The devices 10, 11 have the advantage that, if the bags 1 are punctured in transit, the rigidity of the support provided by the devices is not lost as a consequence of the loss of partial vacuum within the bags. The permanent adherence of the granular material 2 produced by activation of the adhesive coating provides a permanent facsimile of the article being packaged, with intimate permanent support during transit.

Modifications to the described packaging method will be apparent to those skilled in the art. For example, rather than performing all of the steps in a machine as described with reference to FIG. 5, the steps could be performed sequentially on a production line.

Many modifications to the support device fall within the scope of the present invention. For example, the adhesive coating need not necessarily be activated by microwave energy. The adhesive could be activated by a catalyst gas introduced into the bags by a specially adapted form of the valve 4. Also, the adhesive need not necessarily be provided as a coating; the particles of the granular material themselves could be made of a material, such as a plastic material, which, upon suitable treatment, such as heating, could be made to adhere to one another.

I claim:

1. In a device for conforming to the shape of and for supporting a body, comprising an airtight bag containing a granular material, means enabling the bag to be maintained in an evacuated condition, the bag and the material therein being so arranged that when the bag is not evacuated the granular material will flow to allow the bag to assume a shape conforming to the shape of a body to be supported and that when the bag is subsequently evacuated the granular material forms a rigid support in the conformed shape by virtue of compression of the particles against one another, the improvement that the granular material has a surface which can be rendered adhesive whereby, when in said conformed shape, the granules adhere to one another to form a permanently rigid structure in said conformed shape independently of maintenance of the evacuated condition.

2. A device as claimed in claim 1, wherein the granules are coated with an adhesive-convertible substance which normally does not prevent the granules flowing past one another when the bag is non-evacuated, the substance being capable of subsequently being activated from outside the bag when the bag is in the conformed shape such as to adhere the granules to one another and thereby produce the permanently rigid structure.

3. A device as claimed in claim 2, wherein said granular material comprises wood flour coated with said adhesive-convertible substance.

4. A device as claimed in claim 3, wherein said adhesive-convertible substance comprises powdered acrylic material.

5. A device as claimed in claim 3, wherein said adhesive-convertible substance comprises white P.V.A. material.

6. A device according to claim 1, including a non-return valve for maintaining the bag in said evacuated condition.

7. A device for conforming to the shape of and for supporting a body, comprising an airtight bag containing granular wood flour, the bag being flexible to enable it to be deformed to shape the wood flour granules therein to conform to the shape of the body, means enabling evacuation of the bag to cause the wood flour granules to be compressed into a rigid support of said conforming shape, and a powdered acrylic coating on the wood flour granules, activatable from outside the bag to cause the granules permanently to adhere to one another in said rigid conforming shape.

* * * * *